United States Patent [19]

Hasegawa

[11] Patent Number: 4,732,000

[45] Date of Patent: Mar. 22, 1988

[54] OUTPUT CONTROL APPARATUS FOR STIRLING ENGINES

[75] Inventor: Masahiko Hasegawa, Anjyo, Japan

[73] Assignee: Aisin Seiki Kabushiki Kaisha, Kariya, Japan

[21] Appl. No.: 30,376

[22] Filed: Mar. 26, 1987

[30] Foreign Application Priority Data

Mar. 27, 1986 [JP] Japan ..... 61-67369

[51] Int. Cl.[4] ..... F02G 1/06

[52] U.S. Cl. ..... 60/521; 60/525

[58] Field of Search ..... 60/517, 521, 522, 525

[56] References Cited

U.S. PATENT DOCUMENTS

| | | |
|---|---|---|
| 3,371,491 | 3/1968 | Pinter . |
| 3,372,539 | 3/1968 | Reinhoudt . |
| 3,458,994 | 8/1969 | Heffner . |
| 3,466,867 | 9/1969 | Brandes . |
| 3,550,371 | 12/1970 | Jaspers . |
| 3,554,672 | 1/1971 | Brandes . |
| 3,600,886 | 8/1971 | Jaspers . |
| 4,677,824 | 7/1987 | Hasegawa . |

FOREIGN PATENT DOCUMENTS

| | | |
|---|---|---|
| 23534 | 7/1971 | Japan . |
| 23535 | 7/1971 | Japan . |
| 25077 | 2/1984 | Japan . |

OTHER PUBLICATIONS

"Automotive Technology Development Contractors' Coordination Meeting", Oct. 26–29, 1981, Nineteenth Summary Report, pp. 188–195.

*Primary Examiner*—Stephen F. Husar

*Attorney, Agent, or Firm*—Burns, Doane, Swecker & Mathis

[57] ABSTRACT

A Stirling engine control apparatus includes a pressure reducing valve provided in a maximum cycle pressure line connecting a working space to a working gas compressor via a first check valve, a pressure boost valve provided in a minimum cycle pressure line connecting the working space to the working gas compressor via a second check valve, an operating lever pivotable about a movable fulcrum for controlling opening and closing of the pressure reducing valve and the pressure boost valve, an electronic control circuit for driving a motor adapted to move the pivot point, and an unload valve provided in a line shorting intake and discharge sides of the compressor. The electronic control circuit is adapted to move the movable pivot point so as to control working gas pressure in accordance with a reference target pressure decided by engine rotating speed and amount of operating lever displacement in neutral and parking ranges, and in accordance with a practical target pressure obtained by adding a pressure increment to the reference target pressure in a drive range.

2 Claims, 9 Drawing Figures

OUTPUT CONTROL APPARATUS FOR STIRLING ENGINES

BACKGROUND OF THE INVENTION

1. Field of the Invention

This invention relates to an apparatus for controlling the output of a Stirling engine. More particularly, the invention relates to an output control apparatus for a Stirling engine equipped with an automatic transmission.

2. Description of the Prior Art

The output of a Stirling engine, which is an engine of the external combustion type, is determined by the average pressure of a working gas sealed in a working space. When it is desired to raise the output of a Stirling engine, it is necessary to raise the pressure of the working gas in the working space. A typical example of such an output control apparatus for a Stirling engine is disclosed in Japanese Patent Publication (KOKOKU) No. 46-23534. In the disclosed art, however, the feedback of the pressure is performed by piston cylinders and the pressure setting performance is poor. Accordingly, a Stirling engine output control apparatus of a type which relates to the present invention has been proposed to solve this problem. This apparatus will now be described with reference to FIG. 1.

A Stirling engine includes working spaces 1, 2, 3, 4 connected via check valves 5 and a minimum cycle pressure line 6 with a working gas storage tank 7 and a working gas compressor 8. The minimum cycle pressure line 6 has a pressure boosting valve 9. The working spaces 1, 2, 3, 4 are connected via check valves 10 and a maximum cycle pressure line 11 with the compressor 8 and the tank 7, and the maximum cycle pressure line 11 has a pressure reducing valve 12. The opening and closing of the pressure regulating valves 9, 12 of lines 6, 11 is controlled by movement of valve stems 13, 14, respectively. The valve stems 13, 14 are connected to link levers 17, 18 freely pivotable about pivot points 15, 16, respectively. The free ends of the link levers 17, 18 are in contact with a point of application 21 on an operating lever 20 having a grip 19. The operating force acting upon the grip 19 of operating lever 20 can be reduced by suitably selecting the lever ratio of the link levers 17, 18.

The operating lever 20 has a movable pivot point 30 connected to a rack 22 meshing with a pinion 24 fixedly secured to the output shaft of a motor 23. The motor 23 is driven under the control of an electronic control circuit 25. The latter is provided with electric signals from a sensor 26 for sensing displacement of the grip 19 of operating lever 20, a sensor 27 for sensing displacement of the movable pivot point 30 of operating lever 20, a sensor 28 for sensing the line pressure in the minimum cycle pressure line 6, and a sensor 29 for sensing the rotating speed (rpm) of the Stirling engine.

A line 32 having an unload valve 31 is provided for short circuiting the intake and discharge sides of the compressor 8. Since opening the unload valve 31 shorts the intake and discharge sides of the compressor 8, the amount of work done by the compressor 8 is greatly reduced. A solenoid 33 for controlling the opening and closing of the unload valve 31 is actuated by a signal from the electronic control circuit 25.

When the rotating speed of the Stirling engine drops below a fixed value due to application of a load, the unload valve 31 is opened to short circuit the intake and discharge sides of the compressor 8, thereby reducing the amount of work done thereby. Reducing the amount of work prevents a drop in the rotating speed of the Stirling engine to avoid stalling of the engine.

When the driver steps down on the accelerator pedal to displace the grip 19 of operating lever 20 leftward in FIG. 1, the point of application 21 pivots the link lever 17 counter-clockwise about the pivot point 15, whereby the valve stem 13 opens the pressure boosting valve 9. As a result, the working gas in the tank 7 is fed into the working spaces 1, 2, 3, 4 via the minimum cycle pressure line 6 and check valves 5 to elevate the average pressure of the working spaces and, hence, raise engine output. At this time, the electronic control circuit 25 processing the electric signals from the sensors 26, 27, 28, 29 compares a reference target pressure, which depends upon the amount of accelerator pedal depression and the engine rpm, with the actual line pressure. The motor 23 is driven based on the results of the comparison, thereby changing the position of the movable pivot point 30 to control the degree to which the pressure regulating valves 9, 12 open. When the reference target pressure and line pressure become approximately equal, the motor 23 displaces the movable pivot point 30 so as to move the point of application 21 of operating lever 20 to a position that will result in closure of the pressure regulating valves 9, 12. It should be noted that when the driver eases back on the accelerator pedal, the pressure reducing valve 12 is opened by the link lever 18, thereby reducing the pressure in the maximum cycle pressure line 11. The electronic control circuit 25 receiving the outputs of the sensors 26, 27, 28, 29 compares the reference target pressure with the actual line pressure to displace the movable pivot point 30 just as described above.

FIG. 2 is a graph showing the relationship between the reference target pressure and the rotating speed (rpm) of the Stirling engine for accelerator openings of $A=0$, $A=\frac{1}{4}$, $A=\frac{1}{2}$, $A=\frac{3}{4}$, $A=1$. When a Stirling engine is equipped with an automatic transmission having parking (P), neutral (N) and drive (D) ranges, certain phenomena occur which now be described with reference to FIG. 3.

Assume that the Stirling engine having an rpm a and a certain reference target pressure while operating in the parking range P or neutral range N is shifted to the drive range D. Since the load will increase at such time, the rpm of the engine is reduced in the manner shown in FIG. 4 until balance (b) is established with the engine output. On the other hand, since the engine rpm necessary for opening the unload valve 31 is c, a state is reached in which b and c become very close together. Since sudden declines in engine rpm occur in the transition from a to b, as shown in FIG. 4, there is a high risk of engine stalling. Stalling of the engine leads to a rise in gas temperature within the engine heater tubes, as a result of which the heater tubes can be damaged.

SUMMARY OF THE INVENTION

Accordingly, an object of the present invention is to provide a Stirling engine output control apparatus capable of solving the aforementioned problem.

According to the present invention, the foregoing object is attained by providing a Stirling engine output control apparatus comprising a working gas compressor, a maximum cycle pressure line connecting a working space to the working gas compressor via a first check valve, a pressure reducing valve provided in the maximum cycle pressure line, a minimum cycle pressure line connecting the working space to the compressor via a second check valve, a pressure boost valve provided in the minimum cycle pressure line, an operating lever pivotable about a movable pivot point for controlling opening and closing of the pressure reducing valve and the pressure boost valve, a motor for moving the movable pivot point, electronic control means for driving the motor, sensing means for supplying the electronic control means with signals indicative of engine rotating speed, displacement of the operating lever and working gas pressure, and an unload valve provided in a line shorting intake and discharge sides of the compressor. The electronic control means has means for moving the movable pivot point so as to control working gas pressure in accordance with a reference target pressure decided by engine rotating speed and amount of operating lever displacement in neutral and parking ranges, and in accordance with a practical target pressure obtained by adding a pressure increment to the reference target pressure in a drive range.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
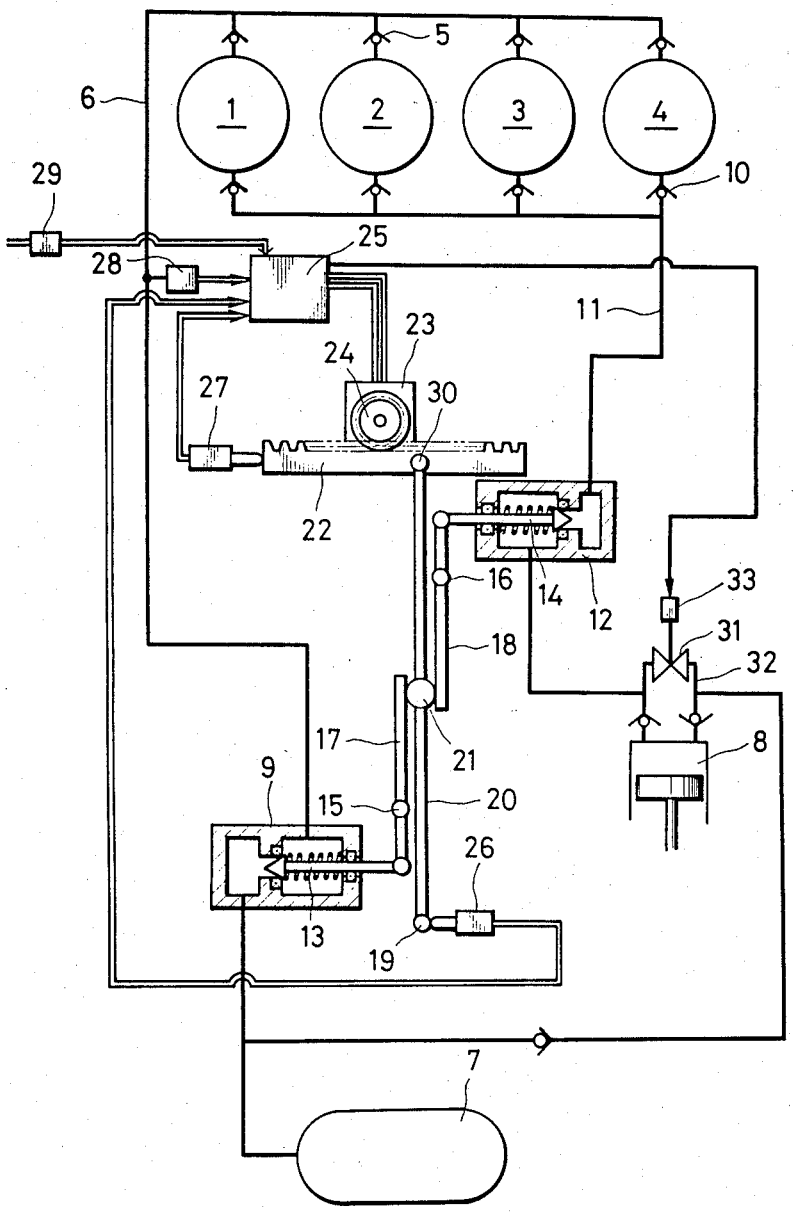
FIG. 1 is a schematic view useful in describing a Stirline engine to which the output control apparatus of the present invention is applied.
Figure 2:
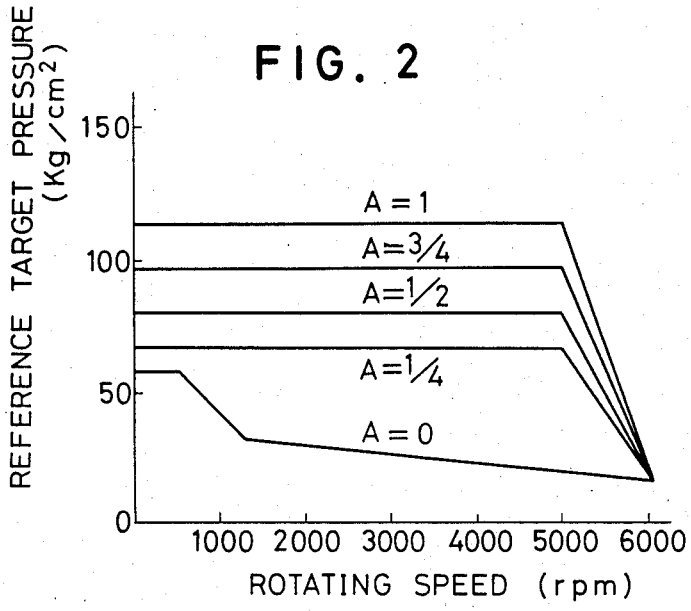
FIG. 2 is a graph illustrating the relationship between engine rpm and a reference target pressure.
Figure 3:
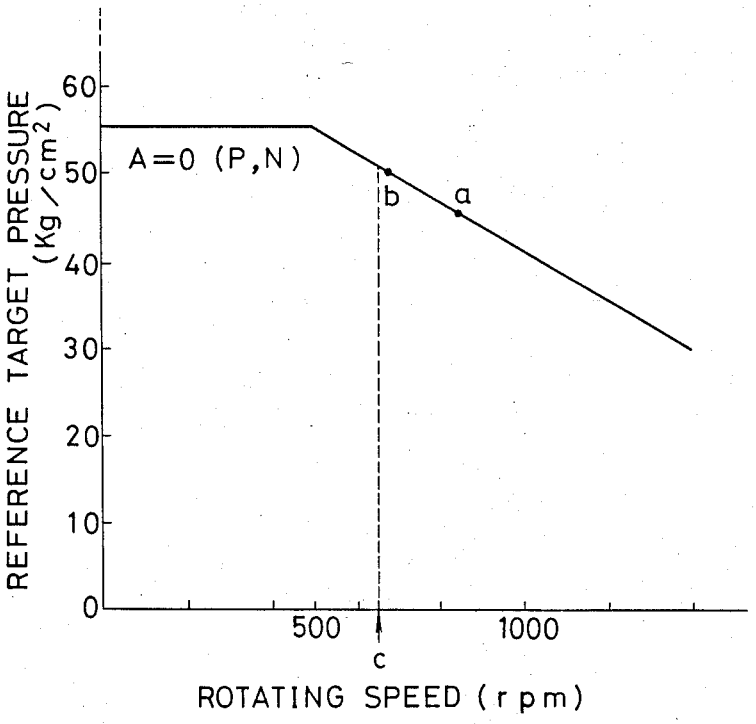
FIG. 3 is an enlarged view of a portion of FIG. 2.
Figure 4:
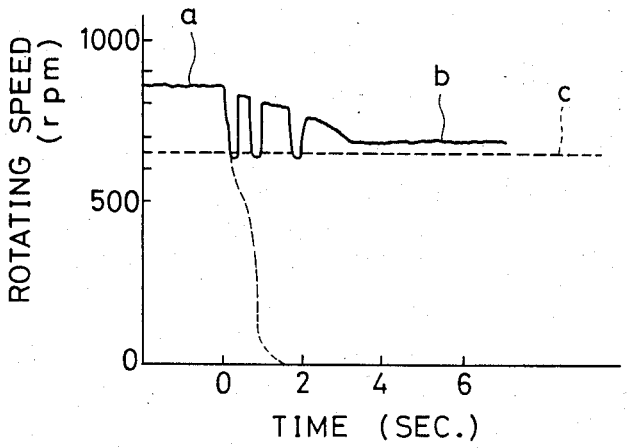
FIG. 4 is a graph illustrating the relationship between time and engine rpm.
Figure 5:
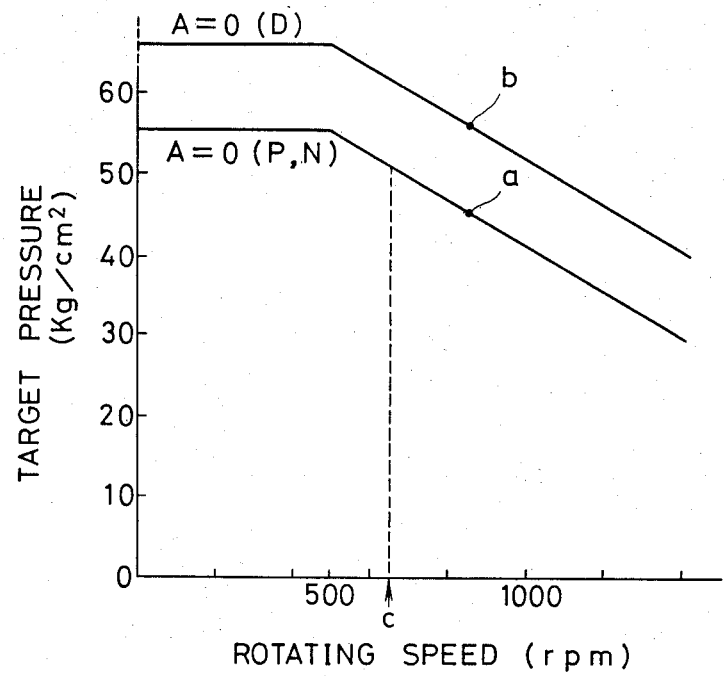
FIG. 5 is a graph illustrating the relationship between engine rpm and a reference target pressure and showing the manner in which the target pressure changes in the drive range.

In accordance with the present invention, as shown in FIG. 5, it is arranged so that when a shift is made from the parking range P or neutral range N to the drive range D, working gas pressure is adjusted in line with a practical target pressure obtained by adding a pressure increment to the reference target pressure. As a result of the adjustment, the set rpm b of the drive range is such that the working gas pressure is higher than that which prevails at the set rpm a of the neutral range.

Further, in accordance with the invention, control for opening and closing the unload valve 31 is carried out when a fixed increase or decrease in Stirling engine rpm occurs with respect to the rpm that prevails when a shift is made to the drive range.

Figure 6:
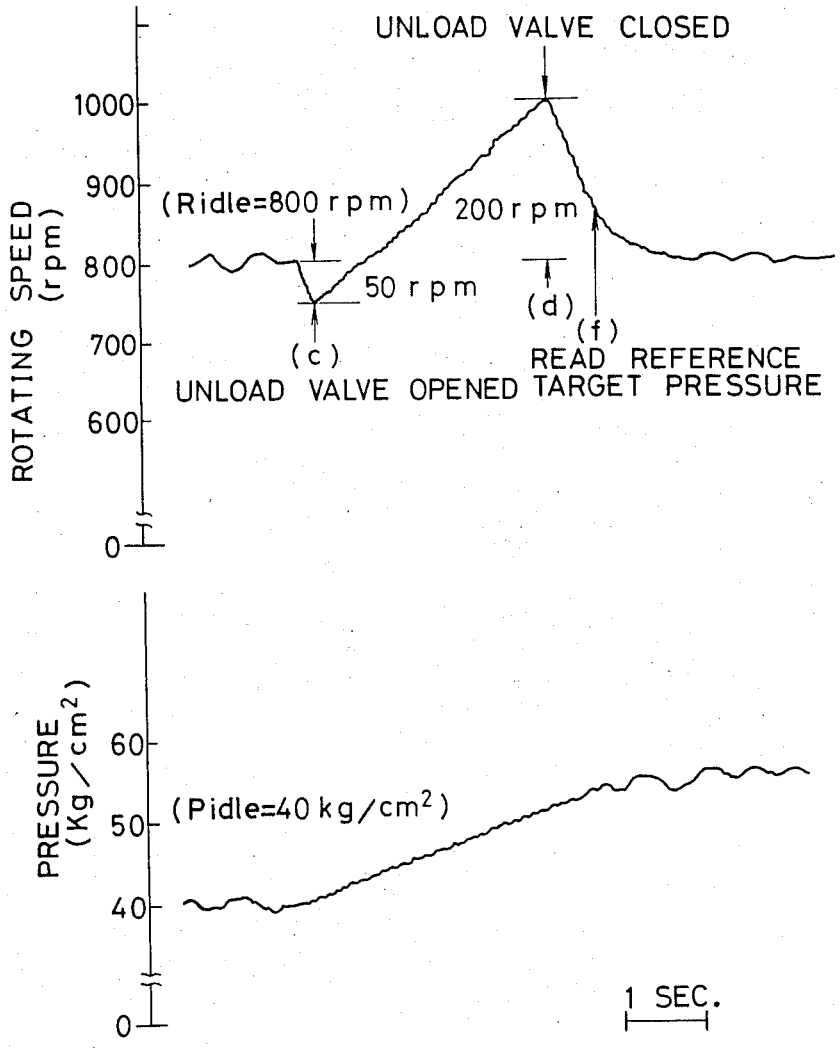
FIG. 6 is a graph showing the relationship among time, pressure and engine rpm.

More specifically, and with reference to FIG. 6, assume that a shift is made to the drive range D when the set rpm a is e.g. 800 rpm in the neutral range. This will cause the working gas pressure to rise from e.g. 40 kg/cm$^2$ over a fixed period of time. During this process, control is applied to open the unload valve 31 when engine rpm decreases by e.g. 50 rpm and to close the unload valve when engine rpm increases by 200 rpm. When this pressure increment reaches a practical reference pressure line, namely at a stage where a new b point is obtained, the working gas pressure is controlled along the new line pressure. As a result, there is no decline in engine rpm even when a shift is made from the neutral range N or parking range P to the drive range D. Moreover, since the working gas pressure is gradually raised, the engine will not stall. In addition, stalling of the engine can be prevented by opening the unload valve 31 at an rpm higher than that of an ordinary rpm set for actuating the valve. Furthermore, as mentioned above, rpm is increased due to a reduction in the amount of compressor work caused by opening the unload valve 31. By closing the unload valve when this increased rpm rises above a fixed rpm, the rotating speed of the engine can be prevented from rising more than necessary.

Operation in accordance with the invention will now be described with reference to the flowcharts of FIGS. 7 through 9.

Figure 7:
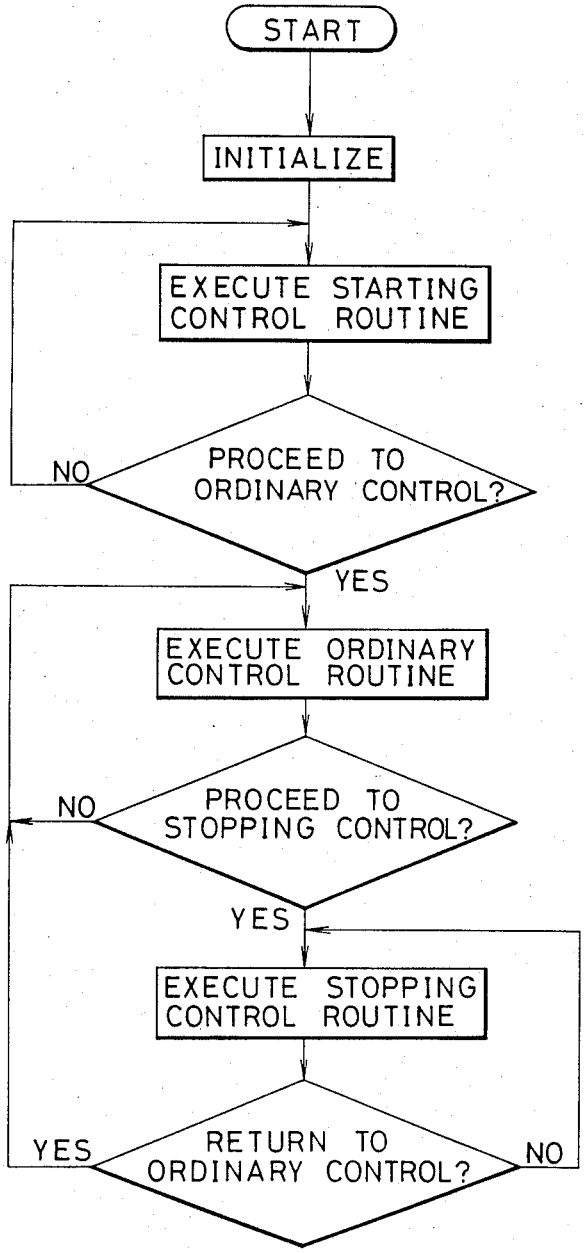
FIGS. 7, 8 and 9 are flowcharts illustrating processing executed by an electronic control circuit in accordance with the invention.

FIG. 7 illustrates the flow of processing executed by the electronic control circuit 25. Step 1 of the flowchart calls for initialization to be carried out, followed by execution at step 2 of a routine for controlling starting of the engine. Next, it is determined at step 3 whether the program is to proceed to ordinary control. If the answer is NO, the program returns to the step 2. If a YES answer is received at the step 3, the program proceeds to step 4 to execute an ordinary control routine. This is followed by step 5, at which it is determined whether the program is to proceed to control for stopping the engine. A NO answer returns the program to the step 4; a YES answer causes the program to proceed to step 6, at which a routine for stopping the engine is executed. Next, it is determined at a step 7 whether to return to ordinary control. If the answer is YES, the program returns to the step 4; if NO, the program returns to the step 6.

Figure 8:
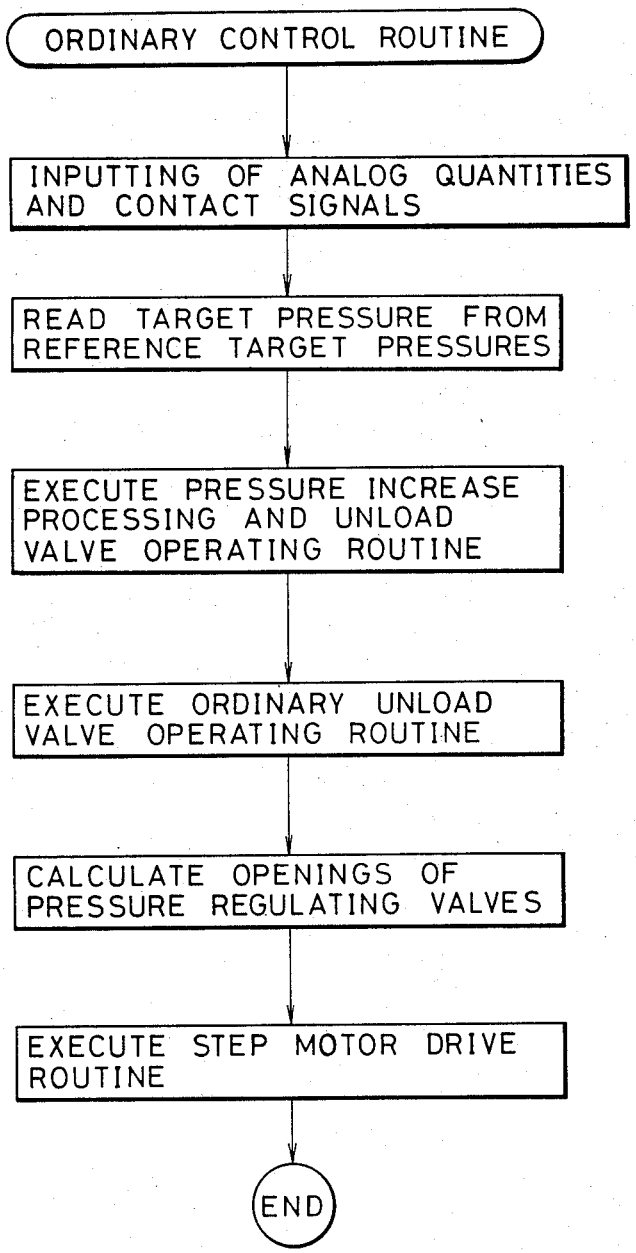
Figure 9:
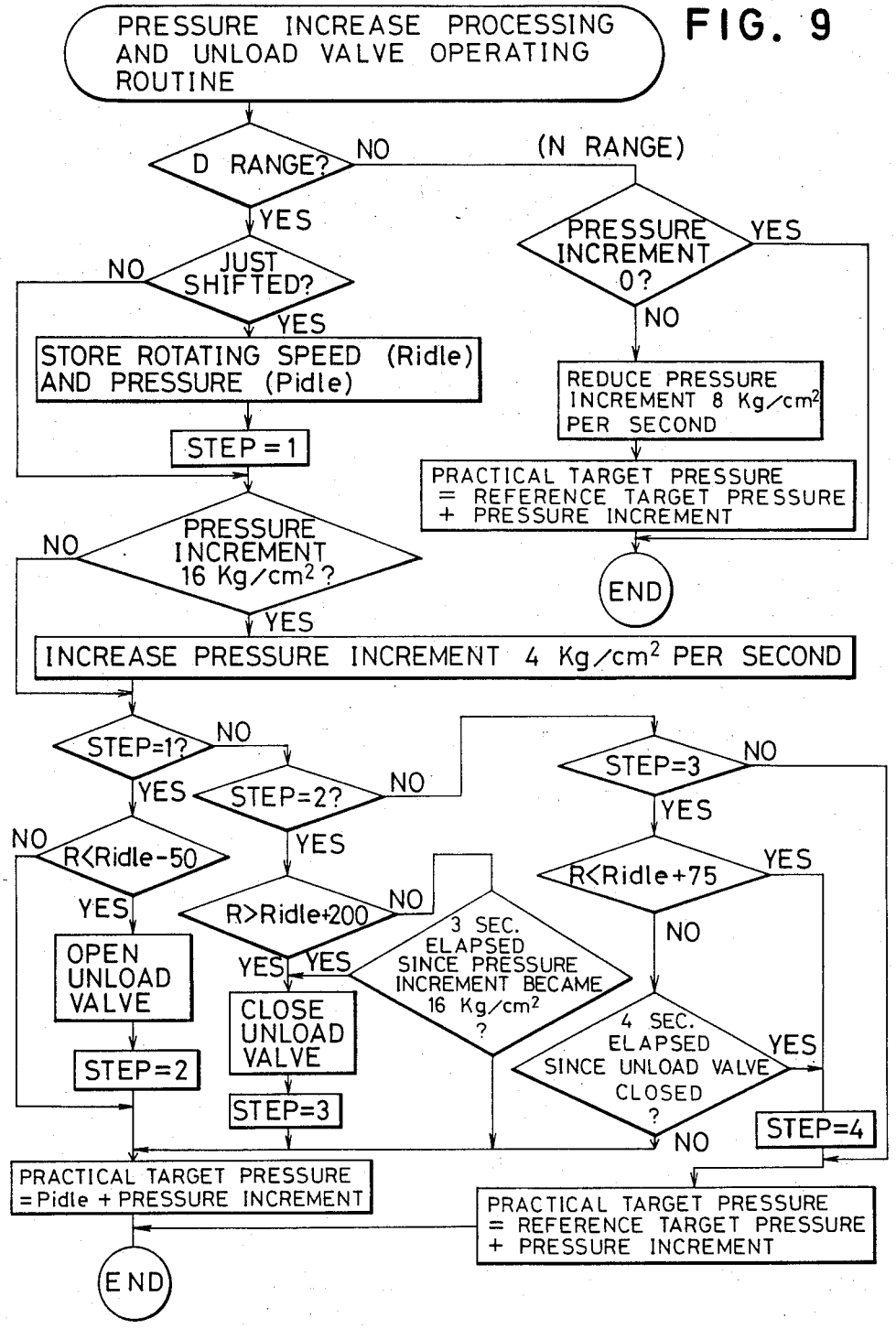

The flowchart of FIG. 8 illustrates the flow of the ordinary control routine. Step 10 of this routine calls for inputting of analog quantities and contact signals. The program then proceeds to a step 11, at which a target pressure is fetched from reference target pressures. Next, step 12 calls for execution of a routine for incremental processing based on a shift and for operating the unload valve 31. This is followed by step 13, at which a routine for ordinary operation of the unload valve 31 is executed, and then by step 14, at which the valve openings of the regulating valves 9, 12 are calculated. The program then proceeds to a step 15, at which a routine for driving the motor 23 is executed.

The routine of step 12 in the flowchart of FIG. 8 is an essential feature of the present invention and will now be described in detail with reference to the flowchart of FIG. 9.

First, at a step 100, it is decided if the transmission is in the D range. If the answer is YES, it is determined at step 101 if the shift has just been made. It the answer is YES, which is based on detection of a signal indicating a shift from the neutral range N or parking range P to the drive range D, then working gas pressure ($P_{idle}$) in the minimum pressure cycle line 6 and engine rotating speed ($R_{idle}$) are stored in memory at step 102. When the pressure increase of the reference target pressure is set to e.g. 16 kg/cm$^2$ (YES at step 103), pressure is raised at a rate of 4 kg/cm$^2$ per second (step 104). The result of adding the pressure increase to the stored pressure serves as the practical target pressure (step 107). If the rpm drops a fixed amount (e.g. 50 rpm) below the stored rpm (YES at step 105), then the unload valve 31 is opened at a step 106 to prevent stalling of the engine caused by a large and sudden drop in engine rpm. It should be noted that it is desirable to open the unload valve 31 early at an rpm higher than the ordinary rpm for actuating the valve.

If the engine rpm rises a fixed amount (e.g. 200 rpm) above the stored rpm (YES at step 108), then the unload valve 31 is closed at step 109. Closure of the unload valve 31 is achieved in a state where the rpm has risen due to an increase in engine output to a extent where the rpm will not fall below the stored rpm, even if a load is applied to the compressor 8. It should be noted that when the engine rpm does not rise by 200 rpm in spite of the pressure increase (NO at step 108), the unload valve 31 is closed a fixed period of time (e.g. three seconds) after the prescribed pressure increase (e.g. 16 kg/cm$^2$) is sensed (YES at step 110). Engine rpm declines due to closure of the unload valve 31. If the rotating speed of the engine falls below that obtained by adding a fixed rpm (e.g. 75 rpm) to the stored rpm (YES at step 111), then the result of adding the pressure increase to the reference target pressure serves as the practical target pressure (step 112). If the rotating speed does not fall below the abovementioned rpm a predetermined time (e.g. four seconds) after the unload valve 31 is closed (YES at step 113), then the reference target pressure serves as the target pressure.

If it is detected that the transmission has been shifted from the drive range D to the neutral range N or parking range P (assume that the former is detected), then it is determined at a step 114 whether the pressure increase is zero. If the answer is NO, the pressure increase is reduced at a rate of e.g. 8 kg/cm$^2$ per second (step 115) and the sum of the reference target pressure and pressure increase serves as the practical target pressure (step 116).

Though it may be contemplated to increase the slope of a target pressure map so that the set rpm in the drive range will not fall to a region that actuates the unload valve or that may result in stalling, hunting tends to occur when setting the pressure. In accordance with the present invention, an arrangement in which the slope of the map has optimum stability can be used commonly for both the neutral and drive ranges. It may be considered to use a separate map for the drive range. However, when target values change suddenly from the map of the neutral range, not only does output temporarily drop due to a sudden change in pressure but there is also a large and sudden change in rpm. The result is instability and an uncomfortable ride when the system is applied to an automobile. By contrast, the present invention smooths the change in rpm since the target pressure is raised in a gradual manner.

As many apparently widely different embodiments of the present invention can be made without departing from the spirit and scope thereof, it is to be understood that the invention is not limited to the specific embodiments thereof except as defined in the appended claims.

What we claim is:

1. A Stirling engine output control apparatus comprising:

a working gas compressor;

a maximum cycle pressure line connecting a working space to said working gas compressor via a first check valve;

a pressure reducing valve provided in said maximum cycle pressure line;

a minimum cycle pressure line connecting said working space to said working gas compressor via a second check valve;

a pressure boost valve provided in said minimum cycle pressure line;

an operating lever pivotable about a movable pivot point for controlling opening and closing of said pressure reducing valve and said pressure boost valve;

a motor for moving said movable pivot point;

electronic control means for driving said motor;

sensing means for supplying said electronic control means with signals indicative of engine rotating speed, displacement of said operating lever and working gas pressure; and an unload valve provided in a line shorting intake and discharge sides of said compressor;

said electronic control means having means for moving said movable pivot point via said motor so as to control working gas pressure in accordance with a reference target pressure decided by engine rotating speed and amount of operating lever displacement in neutral and parking ranges, and in accordance with a practical target pressure obtained by adding a pressure increment to said reference target pressure in a drive range.

2. The output control apparatus according to claim 1, wherein said electronic control means has means for controlling opening and closing of said unload valve when a fixed variation in engine rotating speed occurs with respect to a rotating speed that prevails when a shift is made to the drive range.

* * * * *